United States Patent [19]

Gordon

[11] Patent Number: 4,934,236

[45] Date of Patent: Jun. 19, 1990

[54] SHEET SLICING MECHANISM

[75] Inventor: James F. Gordon, Saratoga, Calif.

[73] Assignee: AM International Corporation, Chicago, Ill.

[21] Appl. No.: 267,838

[22] Filed: Nov. 7, 1988

[51] Int. Cl.[5] ..... B26D 1/30; B26D 7/26

[52] U.S. Cl. ..... 83/563; 83/575; 83/582; 83/632; 83/635; 83/646

[58] Field of Search ..... 83/582, 575, 554, 633, 83/635, 646, 925 CC, 563, 881, 632, 856, 563, 879, 700, 941

[56] References Cited

U.S. PATENT DOCUMENTS

| | | | |
|---|---|---|---|
| 2,515,445 | 7/1950 | Gilstrap | 83/582 X |
| 3,094,031 | 6/1963 | Reeber et al. | 83/575 X |
| 3,511,124 | 5/1970 | Bruns | 83/635 X |
| 4,228,711 | 10/1980 | Insolio | 83/582 X |
| 4,667,553 | 5/1987 | Gerber et al. | 83/925 CC X |
| 4,732,069 | 3/1988 | Wood et al. | 83/881 |

*Primary Examiner*—Douglas D. Watts
*Assistant Examiner*—Rinaldi Rada
*Attorney, Agent, or Firm*—Roy A. Ekstrand; Nicholas A. Camasto

[57] ABSTRACT

A sheet slicing mechanism includes a rigid frame member supporting a stepper motor coupled to a drive gear. A rotatably supportable rotary member includes a driven gear coupled to the drive gear and is rotatably supported upon the frame. A blade frame having a generally cylindrical configuration is received within the rotary member and is freely movable in the vertical axis. The blade frame supports a cutting blade and a cutting force weight. The rotary member defines a vertical slot which cooperates with an outwardly extending pin in the blade frame to permit the blade frame to be vertically movable with respect to the rotary member while locked thereto as to rotational motion. A solenoid activated lifting means is supported upon the frame and is operable to raise the blade frame to a noncutting position.

14 Claims, 2 Drawing Sheets

SHEET SLICING MECHANISM

FIELD OF THE INVENTION

This invention relates generally to cutting and slicing systems operative upon thin sheet material and particularly to automated and computer controlled systems for cutting such materials.

BACKGROUND OF THE INVENTION

In a number of industries, there arises a need to slice or cut various thin planar materials such as plastics or the like. In many cases, these materials are made more difficult to cut due to their thinness and their fabrication from elastic or stretchable materials. One of the materials found to be extremely difficult to cut is the self-adhesive plastic or vinyl sheet material used for labeling, signs, and decoration of various surfaces. Generally, such vinyl or plastic material is formed in a single thin sheet having an adhesive coating on one side which is layered upon a firmer carrier material such as paper. The vinyl or plastic material is cut to the desired shape and then removed from the paper carrier material by peeling the cut portion away from the supporting carrier layer. Because it is often desired to cut such vinyl or plastic material into relatively complex shapes such as letters or designs and because the material is elastic or stretchable, cutting is often a difficult and tedious process. In many instances, such materials are cut by hand using templates or the like in a process which is extremely costly and somewhat inaccurate. In addition, hand cutting is a slow process and requires considerable skill.

The need for better and less costly methods of cutting such thin vinyl or plastic materials has prompted practitioners in the art to make various attempts at creating automated systems for cutting these materials. One of the most promising type of automated cutting system is that which generally resembles a graphic recorder or plotter. In such systems a cutting blade assembly is movably supported upon a track mechanism and is movable back and forth along the track to define a blade path. Means are provided for supporting the cutting blade and for lowering the blade into a cutting position and raising it to a noncutting position. In addition, the blade control mechanism is operative to rotate the cutting blade to provide material cuts in various directions. A media supporting system is positioned beneath the blade carriage track and is operative to support the material and to move the material with respect to the blade carriage path. In most instances, the material is formed to include a plurality of sprocket drive holes adjacent each edge of the material and the sprocketed drive means engage the sprocket holes to control and move the material during the cutting process. In most instances, the directions of blade carriage motion and media motion are mutually perpendicular. Automatic control means, usually including a computer, are operative to coordinate the position of the blade carriage, the blade rotation, and the material movement to produce the desired cuttings of the material.

While such systems have enjoyed some success and provide substantial improvement in many instances over the more costly time consuming hand cutting operations, several problems remain in need of further improvement. One of the more pressing problems in optimizing such automated cutting systems arises in the cutting characteristics of the blade itself. As mentioned, the material is, in many instances, elastic and easily stretched with respect to its supporting medium. As a result, failures of the cutting blade to cleanly slice the material, result in stretching or deforming the material and degrading the quality and accuracy of the cut material piece. In addition, the depth of cut must be carefully controlled to avoid cutting the supporting material while simultaneously assuring a clean cut through the entire material layer.

There arises, therefore, a need for an automatically controllable sheet slicing mechanism which easily and accurately positions and rotates the cutting blade in a sheet slicing mechanism and which accurately maintains the desired depth of material cut.

SUMMARY OF THE INVENTION

Accordingly, it is a general object of the present invention to provide an improved sheet slicing mechanism. It is a more particular object of the present invention to provide an improved sheet slicing mechanism which facilitates automated control of the slicing process. It is a still more particular object of the present invention to provide an improved sheet slicing mechanism operative in an automated process which precisely and easily controls the position and depth of the cutting blade.

In accordance with the present invention, there is provided for use in slicing a thin material supported upon a support media, a sheet slicing mechanism comprising: a frame member; a rotary member defining an internal passage; bearing means rotatably supporting the rotary member upon the frame member such that the internal passage is vertically oriented; a blade frame received within the internal passage and freely movable therein: a cutting blade secured to the blade frame: motor means coupled to the rotary member for causing rotation thereof lifting means coupled to the blade frame for raising the cutting blade; and interlock means for locking the blade frame to the rotary member rotationally while permitting the blade frame to be vertically movable with respect to the rotary member.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
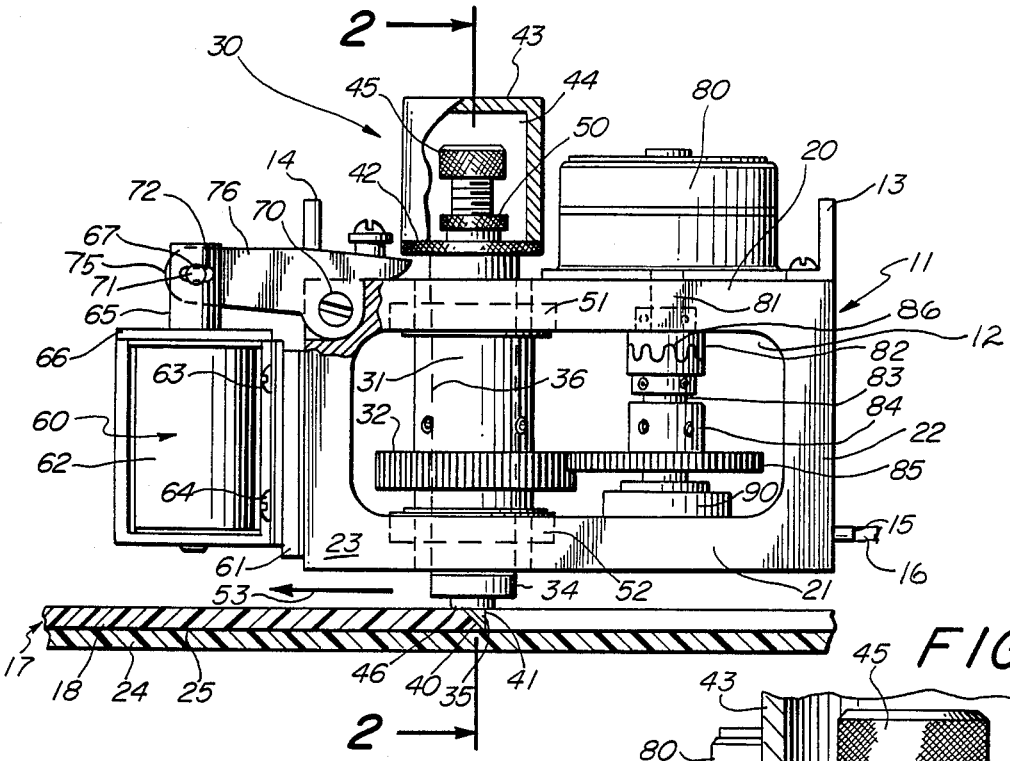
FIG. 1 is a side elevation view of a sheet slicing mechanism constructed in accordance with the present invention during the cutting process.

FIG. 1 sets forth a side view of the present invention sheet slicing mechanism having a slicer assembly generally referenced by reference numeral 10. Slicer assembly 10 includes a rigid frame 11 having an upper plate 20, a lower plate 21, a rear plate 22 and a front plate 23. Plates 20 through 23 are mutually continuous to form a generally rectangular rigid support structure defining a generally rectangular aperture 12 extending laterally therethrough. A pair of upper supports 13 and 14 are secured to upper plate 20 while a second pair of supports 15 and 16 are secured to lower plate 21. Support 16 is not visible in FIG. 1 but should be understood to conform generally to support 15. In accordance with conventional fabrication techniques, supports 13 through 16 are secured to track means (not shown) which support slicer assembly 10 upon a linear support track (not shown). In further accordance with conventional fabrication techniques, it should be understood that slicer assembly 10 is intended to be laterally movable in response to a system control mechanism (not shown). A blade assembly 30 is supported by upper plates 20 and lower plate 21 by means set forth below in greater detail. Blade assembly 30 includes a generally cylindrical rotary member 31 supporting a gear 32 and defining an internal passage 36. A pair of bearings 51 and 52 are secured to the outer surface of rotary member 31 and, by means set forth below in greater detail, rotatably support blade assembly 30 within frame 11. A generally cylindrical blade frame 33 is received within passage 36 of rotary member 31 and defines an outwardly extending lifter flange 42 at its upper end and a heel plate 34 at its lower end. A blade 35, supported by means set forth below in greater detail, defines an inclined cutting edge 40 and a back edge 41 and extends downwardly from heel plate 34. Blade frame 33 further supports a pressure adjustment screw 45 and a lock nut 50 above lifter flange 42. A generally cylindrical weight 43 defines an internal cavity 44 and is supported upon lifter flange 42 and receives pressure adjusting screw 45 and lock nut 50 within cavity 44. While the interior structure of blade frame 33 is set forth below in greater detail, suffice it to note here that, in accordance with an important aspect of the present invention, blade frame 33 is vertically movable within passage 36 and the position of blade frame 33 controls the extension of blade 35 beyond lower plate 21.

A solenoid coil 60 constructed in accordance with conventional fabrication techniques defines a coil frame 66 supporting an electrical coil 62. A pair of fasteners 63 and 64 secure coil frame 66 to front plate 23 of housing 11 via a mounting flange 61. In further accordance with conventional fabrication techniques, solenoid coil 60 includes an elongated actuator 65 movable within coil 62 in response to the energizing thereof. Actuator 65 extends beyond coil frame 66 and defines an aperture 67.

An elongated lifter arm 76 formed of a generally planar material is pivotally supported upon frame 11 by a pivot 70 and defines a lever end 73 extending beneath lifter flange 42 of blade frame 33. Lever arm 76 defines an end portion 75 extending through a slot 68 (seen in FIG. 4) formed in actuator 65. End 75 of lifter arm 76 further defines an elongated slot 72. Actuator 65 defines an aperture 67 which receives a pin 71 extending through slot 72 and coupling actuator 65 to end 75 of lifter arm 76.

A stepper motor 80 constructed in accordance with conventional motor fabrication techniques is secured to upper plate 20 of frame 11 and includes a downwardly extending motor shaft 81 terminating in a coupler 82. Coupler 82 includes a plurality of meshing teeth 86. A shaft 83 is coupled to coupler 82 such that the engagement of teeth 86 provides direct coupling between motor shaft 81 and shaft 83. A gear 85 includes a gear coupling 84 received upon and secured to shaft 83. A bearing 90 is supported upon lower plate 21 and receives the lower end of shaft 83 and provides a rotatable support therefor. Gear 85 engages gear 32 of rotary member 31.

A generally planar support media 24 formed of a heavy paper material or the like is supported beneath slicer assembly 10 by conventional media support means (not shown). A layer of to-be-sliced material formed of a vinyl or plastic material is supported upon support media 24 and secured thereto by an adhesive layer 25.

In operation, the to-be-sliced material generally referenced by numeral 17 which includes a support media 24 preferably formed of a firm paper or the like together with a thinner plastic layer 18 secured to support media 24 by an adhesive layer 25 is supported beneath slicer assembly 10 by means not shown. As mentioned above, slicer assembly 10 is supported by conventional drive means (not shown) which are coupled to supports 13 through 16 and provide motion of slicer assembly 10 with respect to material 17. Rotary member 31 is rotatably supported within frame 11 by bearings 51 and 52 and is coupled to gear 32. As mentioned above, member 31 defines an internal passage 36 which receives blade frame 33 in a sliding engagement. In addition, by means set forth below in greater detail, the angular relationship between blade frame 33 and rotary member 31 is maintained by the sliding lock of pen 37 of blade frame 33 within slot 38 of rotary member 31. Pin 37 and slot 38 are better seen in FIG. 5. Heel plate 34 secures blade 35 to blade frame 33 while weight 43 exerts a downward force upon blade frame 33 which urges blade frame 33 downwardly within rotary member 31 until heel surface 46 contacts plastic layer 18. Weight 43 is selected to provide sufficient downward force to cause blade 35 to penetrate plastic layer 18. In addition as is set forth below in greater detail, blade 35 is positioned such that cutting edge 40 extends beyond heel surface 46 of heel plate 34 a sufficient distance to cleanly cut plastic layer 18 without cutting through media support layer 24. In accordance with an important aspect of the present invention, the entire downward force upon blade 35 is provided by the combined weight of blade frame 33 and its associated components together with weight 43.

With blade frame 33 in the lowered position shown in FIG. 1, blade 35 penetrates plastic layer 18 and as a result, as frame 11 is moved laterally in the direction indicated by arrow 53, plastic layer 18 is cleanly sliced by blade 35. In addition to the vertical motion of blade frame 33, blade assembly 30 in its entirety may be rotated through the action of stepper motor 80. As mentioned above, stepper motor 80 is constructed in accordance with conventional fabrication techniques and includes an output motor shaft 81 which is serially coupled through coupler 82 and shaft 88 to gear coupling 84 and gear 85. Thus, rotation of stepper motor 80 in response to applied signals from the control system (not shown) produces corresponding rotations of motor shaft 81, coupler 82, shaft 83 and gear 85. Because gears 85 and 32 are meshed or interlocked, the rotation of gear 85 causes a corresponding opposite direction rotation of gear 32 which in turn causes a rotation of rotary member 31. Because of the above-described interlock of pin 37 within slot 38 seen in FIG. 5), the rotation of rotary member 31 causes a corresponding rotation of blade frame 33 resulting in a rotation of blade 35. Thus, with blade frame 33 in the lowered or cutting position shown in FIG. 1, the direction of slicing occurring in plastic layer 18 may be altered by the above-described motor driven rotation of rotary member 31. As a result, virtually any direction of cut may be obtained in the present invention system by the appropriate combinations of motions of slicer assembly 10, material 17 and the angular o rotational positioning of blade 35. In accordance with conventional fabrication techniques, the functions of stepper motor 80 and the systems providing motion of slicer assembly 10 and material 17 are coordinated by a computer control system similar to that operative in conventional graphic recorders.

Figure 6:
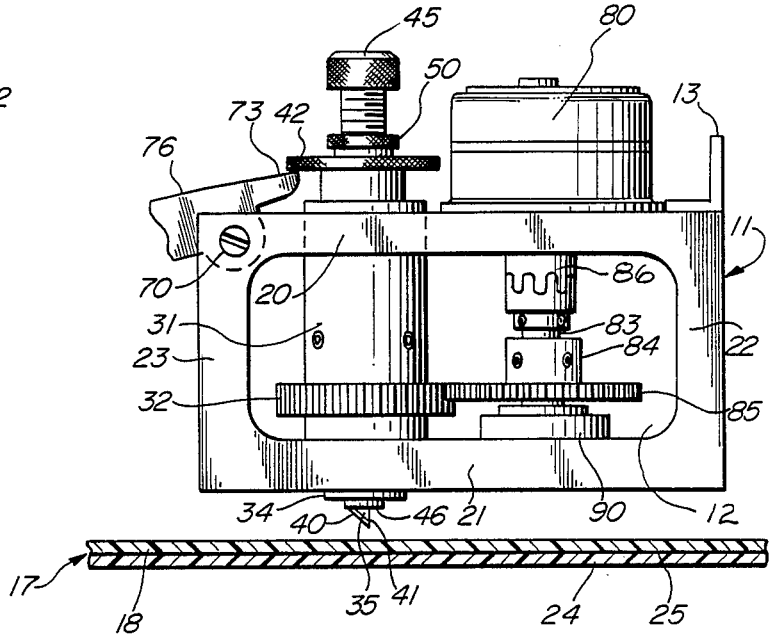
FIG. 6 is a side view of a portion of the present invention sheet slicing mechanism having the cutting blade in a raised position.

In the event it is desired to raise blade 35 from its cutting position shown in FIG. 1 to the noncutting position shown in FIG. 6, solenoid 60 is energized by applying an appropriate electrical signal to electrical coil 62 thereof. In accordance with conventional solenoid operation, the energizing of coil 62 of solenoid 60 causes actuator 65 to be drawn downwardly within coil 62 which in turn draws end 75 of lifter arm 76 downwardly due to the coupling of pin 71 and slot 72. The downward motion of actuator 65 causes a counterclockwise rotation of lifter arm 76 about pivot 70 which in turn raises lever end 73 upwardly toward lifter flange 42. As actuator 65 continues downwardly, the counterclockwise rotation of lifter arm 76 continues and an upward force is exerted upon the underside of lifter flange 42 by lever end 73. This upward force overcomes the combined weights of blade frame 33 and its associated components together with weight 43 resulting in lifting blade frame 33 upwardly within rotary member 31. The travel distance of actuator 65 within coil 62 together with the shape of lifter arm 76 and the location of pivot 70 are selected to ensure that the complete movement of actuator 65 causes lever end 73 to raise blade frame 33 to the fully raised position shown in FIG. 6 in which blade 35 is well above plastic layer 18.

In further accordance with an important aspect of the present invention, the angular position of rotary member 31 and thereby blade 35 may be changed by the above-described action of stepper motor 80 whether blade 35 is in the lowered or raised positions. Once the desired position for the next cut is reached, the energizing signal to coil 62 is interrupted and the combined weight of blade frame 33 and its associated components together with weight 43 causes lifter arm 76 to rotate about pivot 70 in the clockwise direction permitting blade 35 to descend to the cutting position shown in FIG. 1. Once blade 35 is again lowered to its cutting position, the corresponding motions of slicer assembly 10 and material 17 are carried forward together with the appropriate angular positioning of blade 35 through the action of stepper motor 80 to carry forward the next slicing operation. Thereafter, the process is repeated as each desired slice is made of plastic layer 18 between which solenoid 60 is activated to lift blade 85 to its raised position between each desired cut. In most instances, it is desirable to permit plastic layer 18 to remain adhesively attached to support media 24 until the entire cutting process is complete. Thereafter, material 17 is removed from the slicing apparatus and the desired cut pieces of plastic layer 18 are peeled from media support 24 to be applied in accordance with their intended use.

Figure 2:
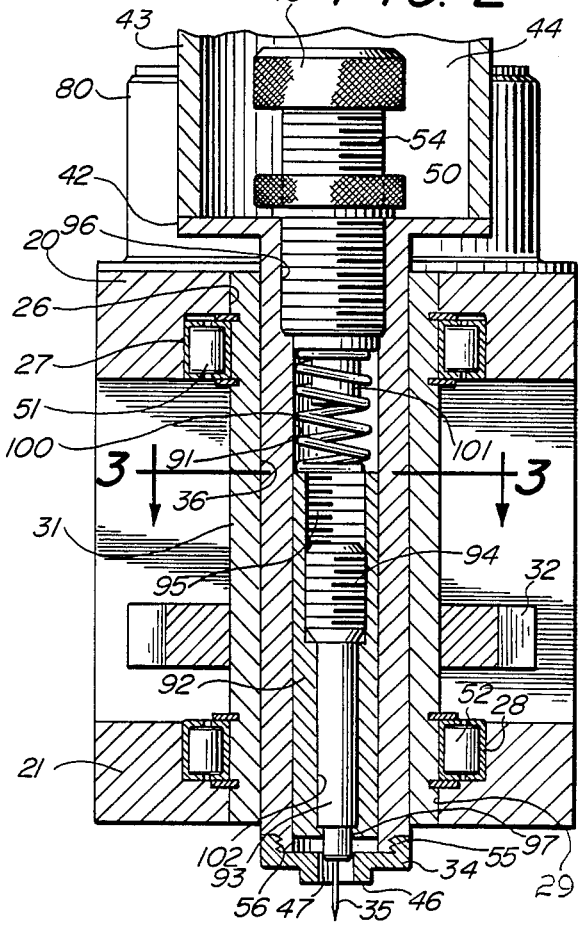
FIG. 2 is a section view of the present invention sheet slicing mechanism taken along section lines 2—2 in FIG. 1.

FIG. 2 sets forth a section view of slicer assembly 10 taken along section lines 2—2 in FIG. 1. Frame 11 includes a vertical rear plate 22, an upper plate 20 and a lower plate 21. Upper plate 20 defines an aperture 26 and a recess 27 concentric with aperture 26. Lower plate 21 defines an aperture 29 and a concentric recess 28. Upper plate 20 further supports stepper motor 80 as set forth above in FIG. 1. Rotary member 31 defines a generally cylindrical shape and supports a pair of roller bearings 51 and 52. Rotary member 31 extends through aperture 26 in upper plate 20 and aperture 29 in lower plate 21. Bearing 51 is received within recess 27 while bearing 52 is received within recess 28. As a result, rotary member 31 is secured between upper plate 20 and lower plate 21 and is rotatable within apertures 26 and 29. Rotary member 31 further defines a passage 36 extending its entire length. Blade frame 33 defines a generally cylindrical member received within passage 36 of rotary member 31 and is freely slidable therein. Blade frame 33 terminates at its lower end in a threaded portion 55 and at its upper end in an outwardly extending lifter flange 42. Blade frame 33 further defines a square cross section passage 91 (better seen in FIG. 3) and a threaded portion 96. A generally cylindrical heel plate 34 defines a center aperture 47 and a threaded portion 56 which is received upon threads 55 of blade frame 33 to secure heel plate 34 thereto. Heel plate 34 further defines a downwardly extending heel surface 46. A generally rectangular elongated blade holder 92 defines a square cross section corresponding to passage 91 and is received therein. Blade holder 92 further defines a cylindrical passage 102 and a threaded passage 95. A blade casing 93 defines a generally cylindrical shape and supports a downwardly extending blade 35. Blade casing 93 is received within passage 102 of blade holder 92 such that blade 35 extends downwardly therefrom and out through aperture 47 in heel plate 34. A blade clamp screw 94 is threadably received within threaded aperture 95 and captivates blade casing 93 against lip 97 of blade holder 92. A pressure adjustment screw 45 defines a plurality of threads 54 which are threadably received within threaded passage 96 of blade frame 33. Pressure adjustment screw 45 further defines a reduced diameter spring boss 101 extending downwardly from threaded portion 54. A spring 101 is captivated between pressure adjustment screw 45 and blade holder 92 within passage 91. Spring boss 101 extends through a portion of spring 100 and maintains the alignment of spring 100 within passage 91. A lock nut 50 is threadably received upon threaded portion 54 of pressure adjustment screw 45 and is locked against lifter flange 42 to maintain the position of pressure adjustment screw 45 within blade frame 33.

In accordance with the present invention, rotary member 31 is freely rotatable within apertures 26 and 29 through the action of bearings 51 and 52 and in accordance with the rotational position of gear 32 in the above-described operation of stepper motor 80 (seen in FIG. 1). In addition, blade frame 33 is freely movable in the vertical direction within passage 36 and is maintained in its lowered position by the combined weight of blade frame 33 and its associated components together with weight 43 in the absence of an upwardly directed lifting force applied by lifter arm 76 in the above-described operation of solenoid coil 60 (seen in FIG. 1). In addition, blade holder 92 is freely movable within passage 91 and is maintained in a downward position by the urging force of spring 100 which is compressively captivated between blade holder 92 and pressure adjustment screw 45. In accordance with the invention, the position of pressure adjustment screw 45 is obtained by rotating lock nut 50 upon threads 54 upwardly from lifter flange 42 and thereafter rotating pressure adjustment screw 45 until threaded portion 54 thereof is threaded into threaded passage 96 of blade frame 33 to compress spring 100 causing it to apply a downward force against blade holder 92. When the desired spring force against blade holder 92 is obtained, the position of pressure adjustment screw 45 is maintained by threading lock nut 50 downwardly upon threads 54 until it abuts the upper surface of lifter flange 42.

In accordance with the present invention, the entire downward force upon blade 35 is provided by the weight of blade frame 33 and its associated components together with weight 43 and the urging force of spring 100. Spring 100 and blade holder 92 cooperate to permit blade 35 to move upwardly with respect to heel plate 34 and thereby absorb minor cutting force variations within the system.

Figure 3:
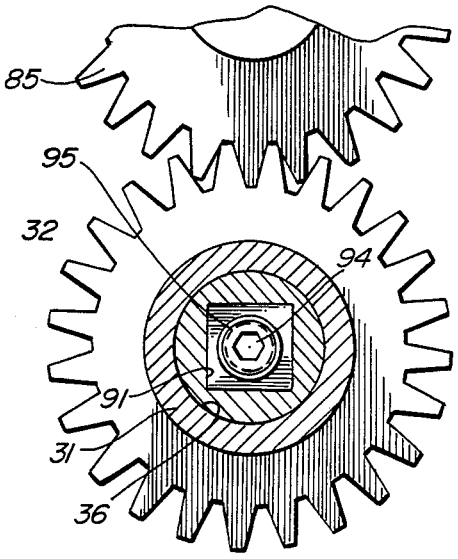
FIG. 3 is a section view of a portion of the present invention sheet slicing mechanism taken along section lines 3—3 in FIG. 2.

FIG. 3 sets forth a partial section view of slicer assembly 10 taken along section lines 3—3 in FIG. 2. A gear 32 is secured to a generally cylindrical rotary member 31 which in turn defines a cylindrical internal passage 36. A cylindrical blade frame 33 defines a square cross section internal passage 91 and is slideably received within passage 36 of rotary member 31. A blade holder 92 defines a square cross section and is received within passage 91. Blade holder 92 further defines an internal threaded passage 95 which receives a blade clamp screw 94 in a threading engagement described above in FIG. 2. A gear 85 is coupled to a stepper motor 80 (shown in FIG. 19) and engages gear 32 to provide rotation of rotary member 31 under the urging of stepper motor 80.

With simultaneous reference to FIGS. 2 and 3, an important advantage of the present invention structure may be seen in the cooperation of square cross section blade holder 92 and square cross section passage 91 defined in blade frame 93. As mentioned above and as is shown in FIG. 5, rotary member 31 and blade frame 33 are slideably locked together by the cooperation of pin 37 and slot 38 (seen in FIG. 5) such that rotation of rotary member 31 causes a corresponding rotation of blade frame 33. The use of square cross sectioned blade holder 92 within square passage 91 preserves the rotational locking between blade frame 33 and blade 35 to assure the accurate angular positioning of blade 35 when gear 32 is rotated by gear 85.

Figure 4:
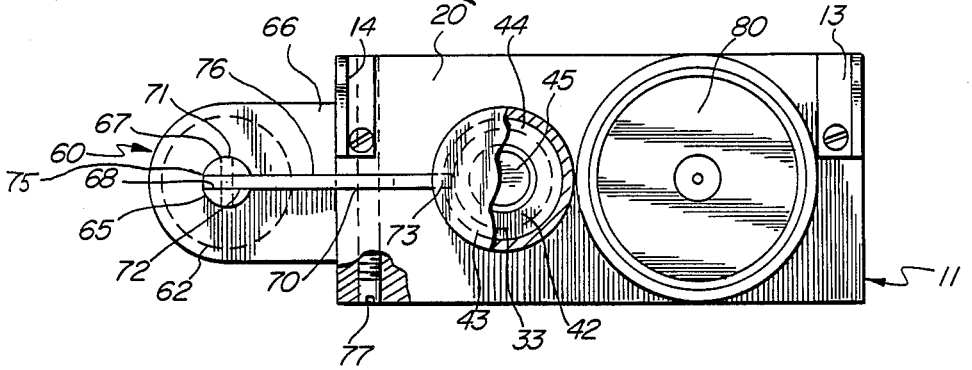
FIG. 4 is a top view of the present invention sheet slicing mechanism.

FIG. 4 sets forth a top view of slicer assembly 10. Frame 11 defines a planar upper plate 20 and a pair of support members 13 and 14. A stepper motor 80 constructed in accordance with conventional fabrication techniques is supported upon upper plate 20 as described above. Blade frame 33 extends through upper plate 20 and terminates in an outwardly extending lifter flange 42. Blade frame 33 further supports a pressure adjustment screw 45 extending above lifter flange 42. A generally cylindrical weight 43 defines an interior cavity 44 which rests upon lifter flange 42 and encloses pressure adjustment screw 45.

An elongated lifter arm 76 is pivotally supported at a pivot 70 by a screw 77 and defines a lever end 73 extending beneath lifter flange 42 and an end portion 75. A solenoid 60 includes a coil frame 66 secured to frame 11 and an upwardly extending actuator 65. Actuator 65 further defines a transverse slot 68 receiving end 75 of lifter arm 76. Actuator 65 further defines an aperture 67 extending therethrough perpendicular to slot 68. As is better seen in FIG. 1, end 75 of lifter arm 76 defines an elongated slot 72 positioned in alignment with aperture 67 when end 75 is received within slot 68. A retaining pin 71 extends through aperture 67 and slot 72 to captivate end 75 of lifter arm 76 within slot 68.

Figure 5:
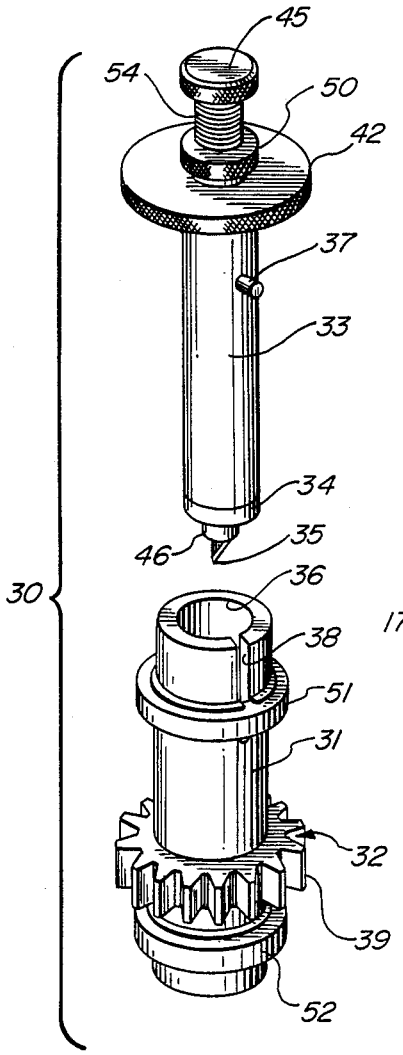
FIG. 5 is an assembly view of a portion of the present invention sheet slicing mechanism.

FIG. 5 sets forth a perspective assembly view of blade assembly 30. Blade frame 33 defines a generally cylindrical member terminating at one end in an outwardly extending lifter flange 42 and supporting a generally cylindrical heel plate 34 at the other end. Heel plate 34 is threadably secured to blade frame 33 as set forth above in FIG. 2 and defines a downwardly extending heel surface 46. As described above, blade 35 is supported within the interior of blade frame 33 and extends downwardly from heel surface 46. A pressure adjustment screw 45 is threadably received within blade frame 33 as described above and is secured in position by a threaded lock nut 50 which abuts and locks against lifter flange 42 to lock pressure adjustment screw 45 in the desired position. A generally cylindrical pin 37 extends outwardly from blade frame 33.

A rotary member 31 defines a generally cylindrical sleeve-like member having a cylindrical interior passage 36 extending therethrough. An elongated slot 38 extends downwardly from the upper end of rotary member 31 and is configured to receive pin 37 when blade frame 33 is received within passage 36. A pair of bearings 51 and 52 are secured to rotary member 31 and provide rotatable support for rotary member 31 when it is assembled within frame 11 as described above in FIGS. 1 and 2. A gear 32 is secured to rotary member 31 and defines a plurality of outwardly extending teeth 39.

In accordance with an important aspect of the present invention, blade frame 33 is received within passage 36 of rotary member 31 in a freely sliding arrangement such that blade frame 33 moves easily in the vertical direction within passage 36. In further accordance with the invention, pin 37 is received within slot 38 of rotary member 31 as blade frame 33 is assembled thereto. The cooperation of pin 37 and slot 38 provides a positive lock between blade frame 33 and rotary member 31 with respect to rotational motion while permitting blade frame 33 to be freely movable with respect to rotary member 31 in the vertical direction.

FIG. 6 sets forth a partial side view of slicer assembly 10 showing blade 35 in its raised position. It should be understood that the figure set forth in FIG. 6 is, for purposes of clarity, somewhat simplified with respect to the detailed side view shown in FIG. 1. Accordingly, frame 11 defines a rear plate 22, a front plate 23, an upper plate 20 and a lower plate 21. A stepper motor 80 is supported upon upper plate 20 and is coupled to a coupler 82, a shaft 83, a gear coupling 84 and a gear 85. Shaft 83 is rotatably supported upon lower plate 22 by a bearing 90. As described above, rotary member 31 is rotatably supported by upper plate 20 and lower plate 21 and includes a gear 32 which engages gear 85. A cylindrical blade frame 33 is received within rotary member 31 in the above-described manner and defines an outwardly extending lifter flange 42. A generally cylindrical heel plate 34 defines a downwardly extending heel surface 46 and is threadably secured to the lower end of blade frame 33. A cutting blade 35 is secured within blade frame 33 in the manner described above and extends downwardly from heel surface 46. A pressure adjustment screw 45 is threadably received within blade frame 33 and, in the manner described above, applies a spring pressure to blade 35. A lock nut 50 is threadably received upon pressure adjustment screw 45 and maintains the proper adjustment thereof.

An elongated lifter arm, the complete structure of which is set forth above in FIG. 1, is pivotally secured to frame 11 by a pivot 70 and defines a lever end 73 extending beneath lifter flange 42 of blade frame 33. A sheet of laminar material 17 is supported beneath slicer assembly 10 in accordance with conventional fabrication techniques (not shown) and defines a support media 24 and a plastic layer 18. Layer 18 is secured to support media 24 by an adhesive layer 25.

As described above, but for the operation of lifter arm 76, blade frame 33 is freely movable in the vertical direction within rotary member 31 and thus falls freely therethrough to permit blade 35 to extend downwardly from lower plate 21 of frame 11. FIG. 6, however, sets forth the positions of lifter arm 76 and blade frame 33 and blade 35 when solenoid 60 (seen in FIG. 1) is energized causing the above-described counterclockwise rotation of lifter arm 76 about pivot 70. As described above, the counterclockwise rotation of lifter arm 76 causes lever end 73 to urge lifter flange 42 upwardly and thus raise blade frame 33 and blade 35 away from material 17. In the raised position shown in FIG. 6, blade 35 is out of contact with plastic layer 18 and therefore does not cut the plastic layer during the motion of slicer assembly 10 and material 17. As is also mentioned above and in accordance with an important aspect of the present invention, the operation of stepper motor 80 during the time that lifter arm 76 has raised blade frame 33 produces a corresponding rotation of gear 32 and thereby blade 35. Thus, stepper 80 may be operated to rotate blade 35 in both the raised position shown in FIG. 6 and the cutting position shown in FIG. 1.

What has been shown is a sheet slicing mechanism suitable for use in a automated slicing system which permits the full rotation of the cutting blade and which provides a predetermined cutting force upon the to-be-sliced media.

While particular embodiments of the invention have been shown and described, it will be obvious to those skilled in the art that changes and modifications may be made without departing from the invention in its broader aspects. Therefore the aim in the appended claims is to cover all such changes and modifications as fall within the true spirit and scope of the invention.

That which is claimed is:

1. For use in slicing a thin material supported upon a support media, a sheet slicing mechanism comprising:

a frame member;

a rotary member defining a first internal passage;

bearing means rotatably supporting said rotary member within said frame member such that said internal passage is vertically oriented;

a blade frame received within said internal passage and freely movable therein;

a cutting blade defining a cutting edge;

blade support means supporting said cutting blade within said blade frame such that said cutting edge is exposed;

motor means coupled to said rotary member for causing rotation thereof;

lifting means coupled to said blade frame for raising said cutting blade; and interlock means for locking said blade frame to said rotary member rotationally while permitting said blade frame to be vertically movable with respect to said rotary member, said blade frame defining a second internal passage and said blade support means including;

a blade holder received within said second internal passage and freely movable therein;

blade attachment means firmly securing said cutting blade to said blade holder with said cutting edge extending downwardly therefrom; and a spring disposed within said second internal passage urging said blade holder downwardly within said second internal passage.

2. A sheet slicing mechanism as set forth in claim 1 wherein said blade frame further includes a threaded adjustment screw threadably received within said second internal passage and wherein said spring is captivated between said adjustment screw and said blade holder.

3. A sheet slicing mechanism as set forth in claim 2 wherein said blade frame defines an upper end and a lower end and includes a threaded cap defining a center aperture threadably received upon said lower end and captivating said blade holder within said second internal passage such that said cutting edge of said cutting blade extends downwardly through said aperture in said cap.

4. A sheet slicing mechanism as set forth in claim 3 wherein said upper end of said blade frame extends beyond said rotary member and defines an outwardly extending flange and wherein said lifting means are coupled to said flange.

5. A sheet slicing mechanism as set forth in claim 4 wherein said lifting means include a solenoid having an actuator coupled to said flange.

6. A sheet slicing mechanism as set forth in claim 5 wherein said lifting means includes an elongated lifter arm having a first end coupled to said actuator, a second end extending beneath said flange, and a pivot support between said first and second ends.

7. A sheet slicing mechanism as set forth in claim 6 further including a removable weight removably attachable to said blade frame.

8. A sheet slicing mechanism as set forth in claim 7 wherein said cap includes a heel surface encircling said cutting blade wherein said heel surface contacts said thin material and the extension of said cutting edge beyond said heel surface determines the cutting depth of said blade.

9. A sheet slicing mechanism as set forth in claim 8 wherein said cap is replaceable.

10. A sheet slicing mechanism as set forth in claim 1 wherein said second internal passage defines a faceted surface and wherein said blade holder is correspondingly faceted.

11. A sheet slicing mechanism as set forth in claim 10 wherein said second internal passage and said blade holder each define square cross sections.

12. A sheet slicing mechanism as set forth in claim 1 wherein said rotary member defines a vertical slot and wherein said blade frame defines an outwardly extending appendage slideably received within said slot.

13. A sheet slicing mechanism as set forth in claim 1 wherein said rotary member includes a plurality of gear teeth encircling said rotary member and wherein said motor means include:

a motor having a rotating output shaft; and a drive gear coupled to said output shaft and engaging said plurality of gear teeth.

14. A sheet slicing mechanism a set forth in claim 13 wherein said motor is an electrical stepping motor.

* * * * *